US008105189B1

(12) United States Patent
Huang

(10) Patent No.: US 8,105,189 B1
(45) Date of Patent: Jan. 31, 2012

(54) ARROW VANE APPARATUS AND METHOD

(76) Inventor: Dorge O. Huang, Henry, IL (US)

( * ) Notice: Subject to any disclaimer, the term of this patent is extended or adjusted under 35 U.S.C. 154(b) by 352 days.

(21) Appl. No.: 12/319,452

(22) Filed: Jan. 7, 2009

(51) Int. Cl.
*F42B 6/06* (2006.01)

(52) U.S. Cl. ..... 473/586

(58) Field of Classification Search ..... 473/585, 473/586

See application file for complete search history.

(56) References Cited

U.S. PATENT DOCUMENTS 2,887,319 A * 5/1959 Lay ..... 473/586
2,976,043 A * 3/1961 Meyer ..... 473/586
3,815,916 A * 6/1974 Meszaros ..... 473/586
4,477,084 A * 10/1984 Austin ..... 473/586
5,024,448 A * 6/1991 Barrie ..... 473/586

* cited by examiner

*Primary Examiner* — John Ricci
(74) *Attorney, Agent, or Firm* — J. Nevin Shaffer, Jr.

(57) ABSTRACT

In arrows with an arrow shaft, an arrow vane apparatus includes an arrow vane for connection with an arrow shaft where the arrow vane includes an inside surface for connection with the arrow shaft. A first outer surface and a second outer surface are provided such that the first outer surface and the second outer surface are connected with the inside surface. Further, the first outer surface and the second outer surface are also connected along an outside edge and the arrow vane includes an air channel.

18 Claims, 2 Drawing Sheets

ARROW VANE APPARATUS AND METHOD

FIELD OF THE INVENTION

This invention relates to an arrow vane apparatus and method. In particular, in accordance with one embodiment, the invention relates, in arrows with an arrow shaft, to an arrow vane for connection with an arrow shaft where the arrow vane includes an inside surface for connection with the arrow shaft. A first outer surface and a second outer surface are provided such that the first outer surface and the second outer surface are connected with the inside surface. Further, the first outer surface and the second outer surface are also connected along an outside edge and the arrow vane includes an air channel.

BACKGROUND OF THE INVENTION

Arrow vanes have not changed much since the use of arrows as projectiles was developed. Typically, the prior art arrow vanes are made of feathers, plastic or real, that are attached to an arrow shaft to create air drag as a steering mechanism to achieve better stability of an arrow during flight.

This traditional, prior art, design causes at least two very undesirable and unavoidable issues: generation of sound and reduction of arrow speed. While more efficient bow and cross bow designs have helped arrows reach speeds of four hundred feet per second, aerodynamic drag is a major speed limiter.

Prior art arrow vanes are made of actual feathers or from semi-rigid plastic. Whatever they are made of they are essentially flat, approximately triangle shaped forms with the small end of the triangle facing forward. To achieve a steering effect, these prior art vanes are connected with the arrow shaft at an angle to the shaft. This provides for a helical effect that causes the arrow to rotate. In this case, as speed goes up, the air friction (drag) also goes up and most of the energy is wasted in spinning the arrow itself. When plastic vanes are used, such high spinning speeds are reached as to cause the arrow to plane and veer uncontrollably off course. A further problem with the prior art is the need to connect the vanes at just the right angle on the arrow shaft, neither too much nor too little.

Other problems exist that are unique to feather vanes. Applicant has determined that feather vanes actually do not initially work at all when used with high poundage bows and cross bows. The feather actually is pressed down and provides no steering effect when shot out of these bows and cross bows. Only after the arrow has slowed significantly do these feather vanes provide the desired steering effect and rotation.

In this regard, plastic vanes are an improvement in that they do not flatten out at first. Here, though, the problem is that the plastic vanes create a large amount of performance reducing torque on the bow string since the arrow begins to turn while still connected with the string.

Another common problem with both feather and plastic vanes is the sound generated by the flat forms and straight edges of these vanes. Hunting is all about stealth. Any reduction in the sound a hunter makes is a big improvement and greatly increases chances for success.

Yet another problem with prior art arrow vanes is that they add weight to the arrow. In particular, thick plastic feather-like arrow vanes can add significant performance debilitating weight to the arrow.

Thus, there is a need in the art for an arrow vane that adds flight stability to an arrow but that does not create noise or add too much drag to the arrow itself or transfer torque to the arrow string during release. It, therefore is an object of the invention to provide an arrow vane that is easy to use and to attach and that is efficient in design such that it is relatively inexpensive to create. It is a further object of the invention to provide an arrow vane that does not create much if any noise when in use, which does not create torque on a bow string and which is light weight. It is a further object of the invention that it does not require the arrow vane to be connected at an angle to an arrow shaft in order to function.

SUMMARY OF THE INVENTION

Accordingly, the arrow vane apparatus of the present invention, according to one embodiment includes, in arrows with an arrow shaft, an arrow vane for connection with an arrow shaft where the arrow vane includes an inside surface for connection with the arrow shaft. A first outer surface and a second outer surface are provided such that the first outer surface and the second outer surface are connected with the inside surface. Further, the first outer surface and the second outer surface are also connected along an outside edge and, importantly, the arrow vane includes an air channel.

As used herein, the terms “arrow” and “arrow shaft” are given their common meaning. A typical arrow includes a shaft to which is attached a cutting blade, commonly called a broad head, for example only and not by way of limitation. On the end of the arrow shaft opposite from the cutting blade is the nock. The nock is used to connect an arrow with a bow string with the bow string inserted in the nock and held there prior to release of the arrow from the bow. Arrow vanes, as discussed above, and as illustrated herein are connected with the arrow shaft near the nock. All of these elements of an arrow are well known and, again, are used with their common meaning herein.

According to another aspect of this embodiment, at least one outer surface is at least partially convex. Again, the term “convex” is given its ordinary and common meaning. A convex surface expands away from a starting point in a structure so as to create a protruded surface not a hollow or concave surface. In another embodiment, at least one outer surface is flat. As used herein the term “flat” means neither convex nor concave. It is a straight, uninterrupted surface. In another aspect, the first outer surface and the second outer surface create a hollow interior space within said arrow vane. In another aspect, the arrow vane is connected approximately parallel with the arrow shaft. In a further aspect, the arrow vane is tapered in thickness top to bottom and front to back. Here again, these terms are given their common meaning such that by referring to the figures, it is clear what is meant without further explanation required. In another aspect, at least one outer surface is at least partially concave. In one aspect, the air channel is located near the inside surface and approximately parallel to the arrow shaft. In another aspect, the arrow vane is connected with the arrow shaft at an angle with the arrow shaft. In another aspect, the arrow vane includes at least one leading arrow vane and a following arrow vane.

According to another embodiment of the invention, in arrows with an arrow shaft, an arrow vane apparatus includes an arrow vane for connection with an arrow shaft where the arrow vane includes an inside surface for connection with the arrow shaft. The arrow vane also includes a first outer surface and a second outer surface where the first outer surface and the second outer surface are connected with the inside surface. The first outer surface and the second outer surface are also connected along an outside edge. The first outer surface is at least partially convex and the second outer surface is flat and the arrow vane is tapered in thickness such that the outside edge is narrower than the inside surface and such that a front of the arrow vane is thicker than a back of the arrow vane. Again, the term "front" as used herein is given its ordinary meaning. In relation, for example only, to an arrow with a cutting edge or point and a nock, the front is closer to the cutting edge and the "back" is closer to the nock.

In another aspect of this invention, the second outer surface is at least partially concave. In one aspect, the arrow vane is connected approximately parallel with the arrow shaft. In another aspect, the arrow vane includes an air channel. In one aspect, the air channel is located near the inside surface of the arrow vane and runs approximately parallel to the arrow shaft. In a further aspect, the arrow vane is connected at an angle with the arrow shaft. In another aspect, the arrow vane includes at least one leading arrow vane and a following arrow vane.

According to another embodiment of the invention, a method for controlling arrows with arrow vanes includes the steps of providing an arrow vane for connection with an arrow shaft where the arrow vane includes: an inside surface for connection with the arrow shaft, a first outer surface and a second outer surface where the first outer surface and the second outer surface are connected with the inside surface and where the first outer surface and the second outer surface are also connected along an outside edge and where the arrow vane includes an air channel; and connecting the inside surface of the arrow vane with the arrow shaft.

In another aspect of the method, the arrow vane is connected approximately parallel with the arrow shaft. In another aspect, the at least one outer surface is curved in accordance with a curve selected from group of curves consisting of: concave and convex. In a further aspect, the method includes connecting more than one arrow vane with the arrow shaft.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
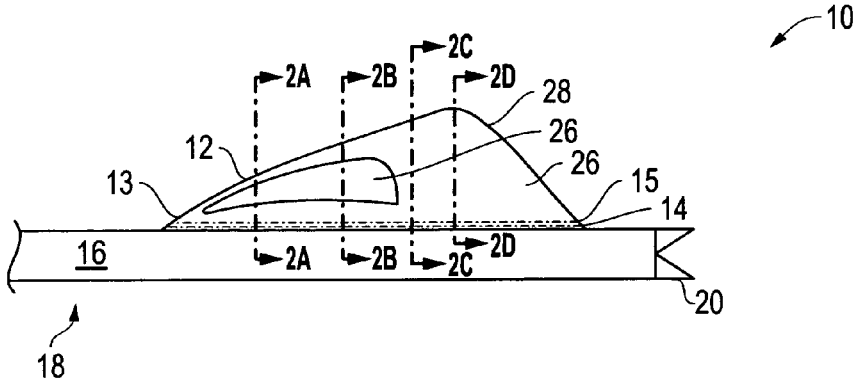
FIG. 1 is a side view of the arrow vane of the present invention according to one embodiment.

The preferred embodiment of the present invention is illustrated by way of example in FIGS. 1-5. With specific reference to FIGS. 1, 2 and 3, arrow vane apparatus 10 includes an arrow vane 12. Arrow vane 12 importantly is made of a sturdy material such as plastic for example only and not by limitation such that arrow vane 12 is rigid but light weight and just slightly flexible as will be discussed more fully hereafter.

Arrow vane 12 includes an inside surface 14. Inside surface 14 is the part of arrow vane 12 that is connected, in a preferred embodiment, with arrow shaft 16. It may be that inside surface 14 is connected to a "foot" 17 that expands the contact surface with the arrow shaft 16 (see FIG. 3) and the foot 17 is connected with the arrow shaft 16. Arrow shaft 16 is part of a typical arrow 18 including arrow nock 20 and other common features, such as a cutting blade (not shown). Again, preferably, inside surface 14 is broad enough or large enough so as to provide ample surface for connection with arrow shaft 16 or with any other intermediary surface such as a foot 17 which is then connected with the arrow shaft 16. Connection may be made with glue or any other connection means or material now known or hereafter developed.

Figure 2A:
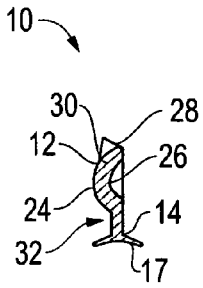
FIG. 2 is a partial cut away perspective view of the arrow vane according to FIG. 1 along lines 2A-A, 2B-B, 2C-C and 2D-D
Figure 2B:
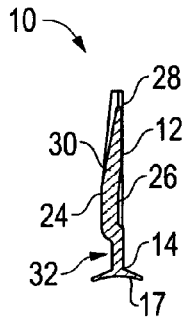
Figure 2C:
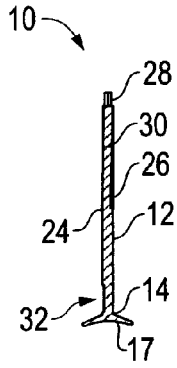
Figure 2D:
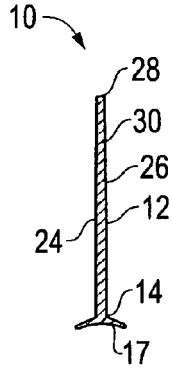

Arrow vane 12 includes first outer surface 24 and second outer surface 26. Importantly, for the purposes of the invention, one of the surfaces is at least partially curved; either convex or concave or both. As shown in the figures, first outer surface 24 is partially convex near the front 13. In another aspect of the invention, second outer surface 26 is flat. FIG. 2A-A shows that second outer surface 26 may be concave, at least partially, while at the same time first outer surface 24 is at least partially convex. In any event, preferably, when combined, first outer surface 24 and second outer surface 26 form an air foil shape. As used herein the term "air foil" describes a shape that has a continuous change of thickness and a curved surface. As illustrated, first outer surface 24 and second outer surface 26 are both connected with inside surface 14 of arrow vane 12. Also, first outer surface 24 and second outer surface 26 are connected along outside edge 28. As a result, due to the convex shape of first outer surface 24, the breadth of inside surface 14 and the narrow outside edge 28, arrow vane 12 is effectively tapered from outside edge 28 to inside surface 14 with the outside edge 28 thin and the bottom of the arrow vane 12 near inside edge 14 thicker. Also, arrow vane 12 is tapered from the front 13 to the back 15 as more clearly shown in FIG. 4. That is, front 13 is thicker than back 15 as illustrated.

The space between first outer surface 24 and second outer surface 26 may be empty, or nearly so, so as to create a hollow interior 30 inside arrow vane 12. This feature allows a user to construct an arrow vane apparatus 10 with as much or as little weight as desired. When completely hollow, arrow vane 12 made of sturdy plastic adds very little weight to arrow 18. Typically, however, Applicant has found that a solid form is light weight and fully functional as well.

Another important improvement and advantage of the arrow vane apparatus 10 of the present invention is that it is designed to be connected with arrow shaft 16 parallel to arrow shaft 16. That is, inside surface 14, and foot 17 if present, need only be aligned parallel, or nearly so, to arrow shaft 16. There are no complex angles to calculate nor is there a risk that the vane won't function well or will function too well as is the case with prior art vanes that are required to be attached to the arrow shaft at an angle.

Figure 4:
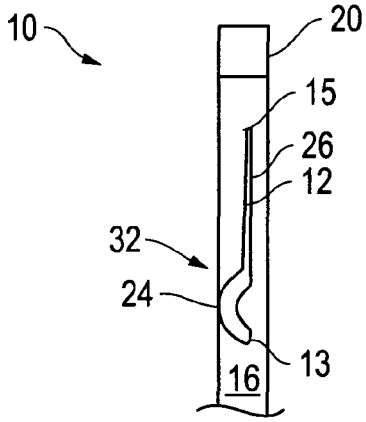
FIG. 4 is a top view of the arrow vane of FIG. 1.

Nonetheless, in circumstances where less powerful bows are used, Applicant has determined that connecting arrow vane 12 with arrow shaft 16 at a slight angle, as shown in FIG. 4, has the effect of increasing the lift caused by arrow vane 12. The "lift" is created by movement of air over the arrow vane 12. With powerful bows common today, no angle is necessary. Like an airplane engine, the powerful bow speeds the arrow vane 12 rapidly through the air so that in a very short distance the air speed across the outer surfaces of arrow vane 12 is sufficient enough to cause the arrow 18 to rotate. With less powerful bows, the air speed is effectively increased by connecting the arrow vane 12 to the arrow shaft 16 at a slight angle of, for example only and not by way of limitation, two degrees from parallel.

Figure 3:
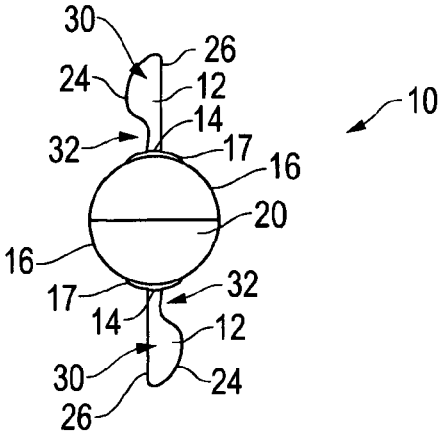
FIG. 3 is an end view of the arrow vane of FIG. 1.

Still referring to FIGS. 1, 2 and 3, a most important aspect of the invention includes air channel 32. As shown, air channel 32 is created in the first outer surface 24 of arrow vane 12. It is located near inside surface 14 and runs parallel to arrow shaft 16 and inside surface 14. As illustrated, particularly with reference to FIGS. 2A-A through 2D-D, air channel 32 need not run the entire length of arrow vane 12. Applicant has determined that air channel 32 enables arrow vane 12 to flex in a consistent and predictable manner. This allows, among other advantages as will be discussed more fully hereafter, arrow vane apparatus 10 to be used with the most powerful bows without fear of breaking the arrow vane 12 or limiting its performance.

Another significant advance created by air channel 32 in arrow vane 12 is that it enables arrow vane 12 to be easily attached to arrow shaft 16 without deforming the shape of arrow vane 12, whether curved or not. That is, whatever its shape, arrow vane 12 in order to be useful and economic must be easily attachable to arrow shafts 16 of any dimension. By means of air channel 32 which helps direct air along arrow vane 12 and which provides arrow vane 12 the ability to flex but not flatten during stress, thus immediately providing steering to the arrow 18 when shot from powerful bows, air channel 32 also provides a universal gripping area. That is air channel 32 allows a user to grip arrow vane 12 along and within air channel 32. This does not deform the arrow vane 12 and allows arrow vane 12 to be easily, accurately and efficiently attached, either directly with inside surface 14 or with foot 17, to arrow shafts 16 of any dimension.

Applicant has determined that a single arrow vane 12 connected with arrow shaft 16 provides an accurate steering effect. Nonetheless, Applicant has determined also that equally spaced arrow vanes 12, as illustrated, one opposite the other has the effect of balancing the arrow 18. Still further, Applicant has determined that three or more arrow vanes (not shown) add progressively more turning speed to the arrow shaft 16. Thus, a user is free to add or delete arrow vanes 12 as desired and in accordance with his or her requirements.

Referring now to FIG. 4, a top view of the arrow vane apparatus 10 is shown with another embodiment. From the top, it is clearly understood that the arrow vane 12 tapers from the thick front 13 to the narrow back 15. From this view it is understood that preferably arrow vane 12 is in the form of an air foil as discussed herein. FIG. 4, along with FIGS. 2A-A and 2B-B, also shows an embodiment of the invention where first outer surface 24 is at least partially convex and second outer surface 26 is at least partially concave. Again, dotted lines illustrate that air channel 32 may be formed in only a portion of the outer surface, in this case the most bulbous or thickest portion near the front 13 of arrow vane 12 as illustrated.

Figure 5:
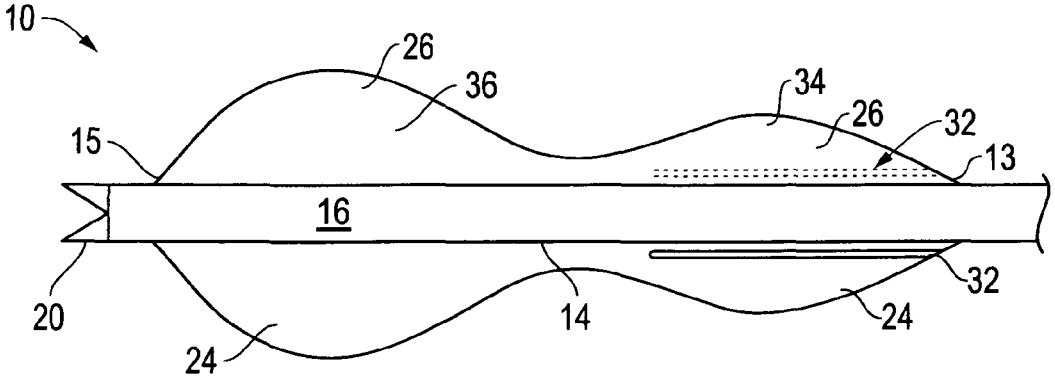
FIG. 5 is a side view of an arrow vane of the present invention according to another embodiment.

Referring now to FIG. 5 another embodiment of the invention is disclosed. In this embodiment there is a leading arrow vane 34 and a trailing arrow vane 36. In this embodiment, the leading arrow vane 34 is smaller than the trailing arrow vane 36 so that together they form, essentially, a single arrow vane 12 but with a much longer inside surface 14, first outer side 24, second outer side 26 and outside edge 28. Applicant has found this embodiment to add another level of stability to the functioning of the arrow 18 in flight. Obviously, more than one leading arrow vane 34 could be added as well.

By way of further explanation, Applicant's arrow vane apparatus 10 utilizes an air channel 32 and, in a preferred embodiment, a form, an air foil, in a unique and heretofore unknown manner. By attaching arrow vanes 12 in the form of air foils to arrow shaft 16 lift is provided by the arrow vanes 12 that cause the arrow 18 to rotate. Applicant has determined, however, that the rotation does not begin while connected with the bow string. Instead, the arrow vane apparatus 10 causes rotation to commence once the arrow 18 has traveled long enough and fast enough to cause enough air to flow over the form so as to cause lift to be created. This is the equivalent to an engine in an air plane. Depending on the power of the engine, a plane must travel down a runway a greater or a lesser distance before reaching take off speed. Because, in powerful bows the arrow vanes 12 are not connected at an angle, rotation is caused by the air passing over the first outer surface 24 and second outer surface 26 at some distance away from the bow and after detachment of the arrow nock 20. Thus, rotation does not occur while the arrow nock 20 is connected with the bow string as with stiff plastic feather vanes attached at an angle.

For less powerful bows, the unique arrow vane 12 is attached at a slight angle to arrow shaft 16. This essentially adds "lift" to the arrow vane 12 and decreases the distance the arrow 18 has to travel before it begins to rotate. Also, since arrow vane 12 is made of rigid material, with either powerful or weaker bows, the arrow vane 12 maintains its position relative to arrow shaft 16. This means that steering effect is always provided, unlike feather vanes that collapse as discussed above. Further, because there are no sharp, square edges but only tapered curved surfaces, there is markedly less noise produced.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. In arrows with an arrow shaft, an arrow vane apparatus comprising: an arrow vane for connection with an arrow shaft wherein said arrow vane includes an inside surface for connection with said arrow shaft, a first outer surface and a second outer surface wherein said first outer surface and said second outer surface are connected with said inside surface and wherein said first outer surface and said second outer surface are also connected along an outside edge and wherein at least one outer surface is at least partially convex and wherein said arrow vane includes an air channel.

2. The apparatus of claim 1 wherein at least one outer surface is flat.

3. The apparatus of claim 1 wherein said arrow vane is connected approximately parallel with said arrow shaft.

4. The apparatus of claim 1 wherein said arrow vane is tapered in thickness top to bottom and front to back wherein the bottom and front are thick and the top and back are thin.

5. The apparatus of claim 1 wherein at least one outer surface is at least partially concave.

6. The apparatus of claim 1 wherein said air channel is located near said inside surface and approximately parallel to said arrow shaft.

7. The apparatus of claim 1 wherein said arrow vane is connected with said arrow shaft at an angle with said arrow shaft.

8. The apparatus of claim 1 wherein said arrow vane includes at least one leading arrow vane and a following arrow vane.

9. In arrows with an arrow shaft, an arrow vane apparatus comprising:

a. an arrow vane for connection with an arrow shaft wherein said arrow vane includes an inside surface for connection with said arrow shaft, a first outer surface and a second outer surface wherein said first outer surface and said second outer surface are connected with said inside surface and wherein said first outer surface and said second outer surface are also connected along an outside edge and wherein said first outer surface is at least partially convex; and b. wherein said second outer surface is flat and wherein said arrow vane is tapered in thickness such that the outside edge is narrower than said inside surface and such that a front of the arrow vane is thicker than a back of the arrow vane.

10. The apparatus of claim 9 wherein said second outer surface is at least partially concave.

11. The apparatus of claim 9 wherein said arrow vane is connected approximately parallel with said arrow shaft.

12. The apparatus of claim 9 wherein said arrow vane includes an air channel.

13. The apparatus of claim 12 wherein said air channel is located near said inside surface and approximately parallel to said arrow shaft.

14. The apparatus of claim 9 wherein said arrow vane is connected at an angle with said arrow shaft.

15. The apparatus of claim 9 wherein said arrow vane includes at least one leading arrow vane and a following arrow vane.

16. A method for controlling arrows with arrow vanes comprising:

a. providing an arrow vane for connection with an arrow shaft wherein said arrow vane includes an inside surface for connection with said arrow shaft, a first outer surface and a second outer surface wherein said first outer surface and said second outer surface are connected with said inside surface and wherein said first outer surface and said second outer surface are also connected along an outside edge and wherein said arrow vane includes an air channel and wherein at least one outer surface is curved in accordance with a curve selected from group of curves consisting of: concave and convex; and b. connecting the arrow vane with said arrow shaft.

17. The method of claim 16 wherein said arrow vane is connected approximately parallel with said arrow shaft.

18. The method of claim 16 further including connecting more than one arrow vane with said arrow shaft.

* * * * *